US007786394B2

(12) United States Patent
Gao et al.

(10) Patent No.: US 7,786,394 B2
(45) Date of Patent: Aug. 31, 2010

(54) BACKLIGHT KEYBOARD

(75) Inventors: Jin-Feng Gao, Shenzhen (CN); Che-Yuan Hsu, Taipei Hsien (TW); Ken-Holm Hansen, Farevejle (DK)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 423 days.

(21) Appl. No.: 11/829,864

(22) Filed: Jul. 27, 2007

(65) Prior Publication Data

US 2008/0129551 A1 Jun. 5, 2008

(30) Foreign Application Priority Data

Dec. 1, 2006 (CN) ..... 2006 1 0157219

(51) Int. Cl.
*H01H 9/00* (2006.01)

(52) U.S. Cl. ..... 200/314

(58) Field of Classification Search ..... 200/314, 200/512, 517; 362/624, 627
See application file for complete search history.

(56) References Cited

U.S. PATENT DOCUMENTS

| | | | | |
|---|---|---|---|---|
| 5,225,818 | A * | 7/1993 | Lee et al. | 345/170 |
| 6,217,183 | B1 | 4/2001 | Shipman | |
| 6,444,928 | B2 * | 9/2002 | Okamoto et al. | 200/5 A |
| 2004/0061136 | A1 * | 4/2004 | Tyan et al. | 257/200 |
| 2005/0083672 | A1 * | 4/2005 | Shipman et al. | 362/26 |
| 2005/0109238 | A1 * | 5/2005 | Yamaki et al. | 106/287.16 |
| 2006/0260923 | A1 * | 11/2006 | Lee et al. | 200/314 |

FOREIGN PATENT DOCUMENTS

| | | |
|---|---|---|
| CN | 2791664 | 6/2006 |
| CN | 1848328 | 10/2006 |
| CN | 2829042 | 10/2006 |
| TW | 200402363 | 2/2004 |
| TW | I256009 | 6/2006 |

* cited by examiner

*Primary Examiner*—Edwin A. Leon
*Assistant Examiner*—Vanessa Girardi
(74) *Attorney, Agent, or Firm*—Jeffrey T. Knapp

(57) ABSTRACT

A backlight keyboard (100) includes a plurality of keys (120), a light guide plate (140), and an elastic element (160). Each key includes a key cover (124) and a keypad (122) integrally connected to each other. Further, keypad portions of adjacent keys are integrally connected, as well. The light guide plate is arranged below the keys. The light guide plate defines a plurality of through holes (142), each through hole corresponding to one key. An opaque film (144) is coated on a top surface of the light guide plate. The elastic element is positioned under the light guide plate and is configured for exerting a biasing force on at least one key so as to enable the key to return to its previous position when pressed and released.

16 Claims, 1 Drawing Sheet

BACKLIGHT KEYBOARD

BACKGROUND OF THE INVENTION

1. Field of the Invention

The present invention relates to backlight keyboards and, particularly, to a backlight board used in a portable electronic device.

2. Description of Related Art

In a portable electronic device, a typical keyboard includes a plurality of keys, which display symbols, such as those found on typical alphanumeric keys, on their top surfaces. Moreover, this kind of keyboard is activated by depression of a key for identifying a particular symbol embedded on the top of the key. A problem with this kind of keyboard is that it is often difficult to discern the symbol appearing on the top of the key, under poor lighting conditions.

In order to solve the above problem, discrete light-emitting diodes (LEDs) are surface-mounted on a circuit board to provide illumination to a keypad. A light guide plate is arranged between the keypad and the circuit board for guiding light from one or more light sources on the circuit board to the proximity of the keypads.

However, the light guide plate not only guides light to each key, but also guides light to the area around keys. Accordingly, light from the LEDs not only illuminates each key but also illuminates other areas around keys. This wastes light and makes the symbols on the keys harder to discern/view.

Therefore, a backlight keyboard, which will efficiently use light from LEDs, is desired in order to overcome the above-described shortcomings.

SUMMARY OF THE INVENTION

One present embodiment of a backlight keyboard includes a plurality of keys, a light guide plate, and an elastic element. Each key includes a key cover and a keypad connected to each other. The light guide plate is arranged below the keys. The light guide plate defines a plurality of through holes, with each through hole corresponding to a key. An opaque film covers (either partially or wholly) a top surface thereof. The elastic element is positioned under the light guide plate and is configured for exerting a force on at least one key, so as to enable the key to return to its previous position upon being pressed and released.

Other advantages and novel features will become more apparent from the following detailed description when taken in conjunction with the accompanying drawing.

BRIEF DESCRIPTION OF THE DRAWING

Many aspects of the backlight keyboard can be better understood with reference to the following drawing. The components in the drawing are not necessarily drawn to scale, the emphasis instead being placed upon clearly illustrating the principles of the present backlight keyboard. Moreover, in the drawing, like reference numerals designate corresponding parts throughout the several views.

DETAILED DESCRIPTION OF THE EMBODIMENTS

Figure 1:
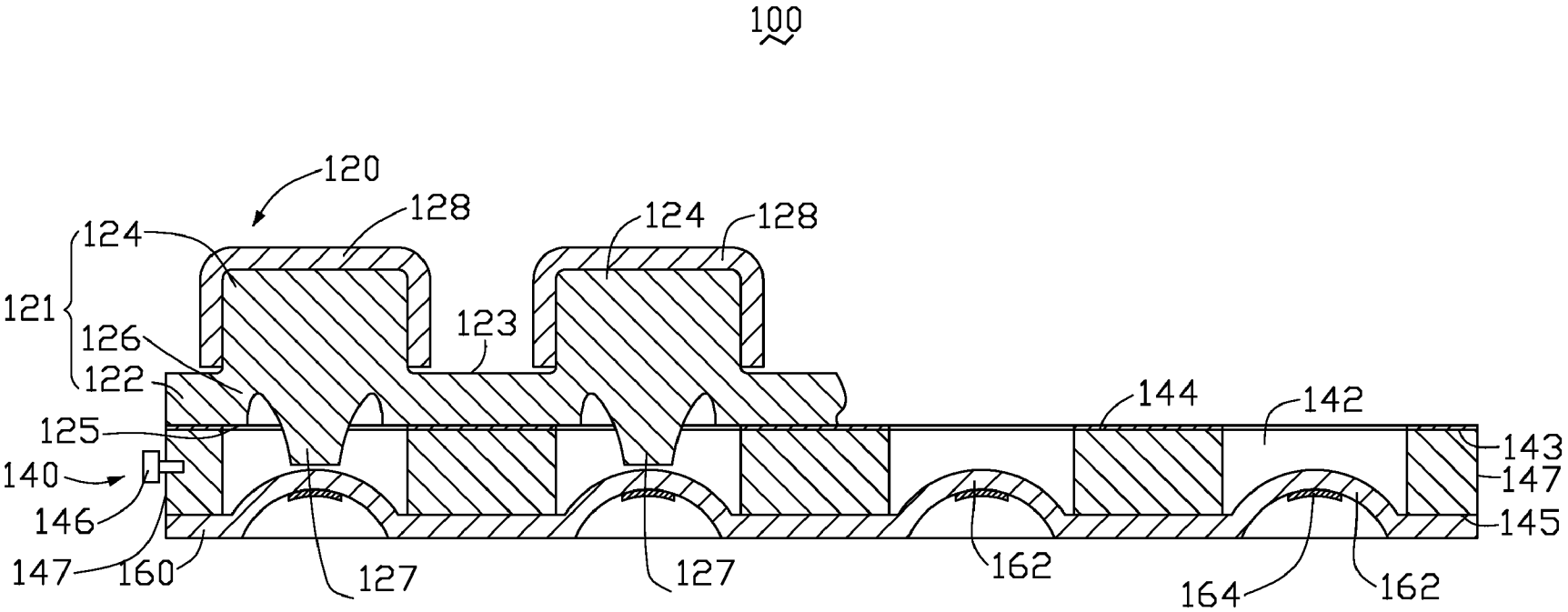
FIG. 1 is a cross-sectional view of a backlight keyboard, according to one present embodiment.

Referring now to the drawing in detail, FIG. 1 shows a backlight keyboard 100, in accordance with one embodiment. The backlight keyboard 100 includes a plurality of keys 120, a light guide plate 140, and an elastic member 160. The keys 120 are arranged above the light guide plate 140, and the elastic member 160 is positioned below the light guide plate 140.

Each key 120 includes a key body 121 and a key cap 128. Each pair of adjacent key covers 124 has a space therebetween and is integrally linked via a portion of a keypad 122. The key body 121 is beneficially made of light diffusing transparent material, such as rubber, so that light may diffusively pass therethrough. The key body 121 includes the keypad 122, a key cover 124, and a connecting portion 126. The keypad 122 has an upper surface 123 and a lower surface 125 on a side of the keypad 122 opposite to the upper surface 123. The key cover 124 is, usefully, substantially cylindrical but could instead be, e.g., substantially rectangular, depending on the desired key shape. The key cover 124 is positioned directly on the keypad 122, and the connecting portion 126 integrally connects the key cover 124 to the keypad 122. The connecting portion 126 is thinner than the keypad 122 and is thus configured for performing a clicking/spring-bias movement and for supporting the key cover 120. The key cover 124 has a projection 127 integrally formed on/from a bottom thereof. The key cap 128 is, beneficially, made of plastic material, allowing for a greater level of hardness and durability. The key cap 128 is placed over the key cover 124 and can be fixed on the key cover 124 using an adhesive. Each key cap 128 has a light-permeable letter, character, a symbol, a figure, and/or the like for identifying each key 120. It is understood that the key cap 128 may be manufactured in such a way that the key-identifying character/symbol is more light permeable than the remainder of the given key cap 128, in order to allow the given key-identifying character/symbol to be more readily distinguished, even under low-light conditions.

The light guide plate 140 is made of light-transmitting material, such as methacrylate resin, polycarbonate (PC), polymethyl methacrylate (PMMA), and/or acrylonitrile butadiene styrene (ABS) resin. The light guide plate 140 has a top surface 143, a bottom surface 145, and four sidewalls 147. The light guide plate 140 defines a plurality of through holes 142 therein. Each through hole 142 is positioned corresponding to its respective key cover 124. Each through hole 142 communicates with the top surface 143 and the bottom surface 145. A diameter of each through hole 142 is approximately the same as that of the key cover 124. An opaque film 144 covers (either partially or wholly) the top surface 143 of the light guide plate 140, except in the places corresponding to the through holes 142 thereof. It is to be understood that the opaque film 144 could take the form of a reflective film, with the reflective side thereof facing the bottom surface 145, in order to help maximize light use within the light guide plate 140. A plurality of light sources 146 such as LEDs are positioned parallel along one of sidewalls 147 of the light guide plate 140 for illuminating the whole light guide plate 140.

An exemplary method of forming the opaque film 144 is that used in forming a baked-on varnish/enamel. In this method, the initial/unfinished light guide plate 140 is firstly hung in place on a rack. Then, the light guide plate 140 is treated using electrostatic dust for removing dust and static electricity. After that, the light guide plate 140 is coated. The coating process is, advantageously, carried out three times so as to achieve a suitable thickness for the opaque film 144, although it is to be understood that such number of process times could be varied, depending, e.g., on the thickness desired and the coating materials being employed. After each coating process is finished, the light guide plate 140 is left to stand for some time to allow for drying/curing (depending on the coating material employed). This multi-step coating process helps achieve a uniform top surface 143. Next, the light guide plate 140 is baked, thereby finishing the process of creating the baked-on varnish. Finally, the light guide plate 140 needs to be cut so as to form the plurality of through holes 142.

The opaque film 144 may instead be formed by electroplating. In such a case, the light guide plate 140 should be made of a material that can undergo plating, such as a compound of PC and ABS. The plating material may be nickel, chromium, or the like. Alternatively, the opaque film 144 may be formed by physical vapor deposition (PVD) method. The coating material may be aluminium, stainless steel, or a titanium compound, such as TiC, TiCN, or TiAlN (wherein C is carbon, Al is aluminum, and N is nitrogen). Alternatively, the opaque film 144 may be formed by printing, and the printing material can be made of a light silver ink.

This opaque film 144 is made of an opaque material. The opaque material may have absorbing properties or may have highly reflective properties, thereby blocking light which would otherwise be emitted from the area around the key cover 124 of the key 120. Therefore, only the key covers 122 and key caps 128 are irradiated/illuminated and so there is effective irradiation/illumination and as little light loss as possible. If the material of the opaque film 144 has an absorbing property, the light energy from the light sources 146 cannot escape from around the key covers 124, thus ensuring effectively irradiation/illumination of the corresponding keys 120. If the opaque film 144 is highly reflective, the opaque film 144 may repeatedly reflect light from LEDs 146 in the light guide plate 140 so as to effectively reflect light to the corresponding keys 120. Therefore, light is not leaked to the outside making it possible to light the keys 120 even more brightly.

The elastic member 160 includes a plurality of dome sections 162 constructed so as to allow their elastic deformation. The elastic member 160 is mounted to the bottom surface 145 of the light guide plate 140, and the dome sections 162 thereof respectively extend into the corresponding through holes 142 and away from the bottom surface 145. The dome sections 162 are each so formed that a front surface of each dome section 162 expands outwardly toward a respective one of projections 127. The dome sections 162 each have a contact 164 formed on a rear surface thereof. The dome sections 162 each abut against a corresponding one of the projections 127 so that the key cover 124 may be forcedly pressed against the corresponding dome section 162 and thereby deform such dome section 162 so as to bring the contacts 164 into contact, electrically, with a printed circuit board.

In assembly, the keys 120 are positioned above the light guide plate 140, and the lower surfaces 125 of the keypads 122 are on an opposite side to the top surface 143 of the light guide plate 140. The projection 127 of each key cover 124 extends into the corresponding through hole 142, via the top surface 144 of the light guide plate 140. The elastic member 160 is positioned under the light guide plate 140. Each dome section 162 is positioned opposite to a corresponding through hole 142 and is received therein. Each projection 127, in turn, is located opposite to a corresponding dome section 162.

In use, when a force is applied to the key cap 128 of the key 120, the key cover 124 moves downward. The projection 127 further pushes the dome section 162 of the elastic member 160, causing the dome section 162 to deform. Accordingly, with sufficient deformation of the dome section 162, the contact 164 contacts with the printed circuit board so as to create an electrical connection. When the force is removed, the key cover 124 returns to an original state under the biasing role of the connecting portion 126 and the dome section 162, so as to finish the operation process of the key 120. Because there is a non-light-transmitting coating formed on the top surface of the light guide plate 140, except where the keys 120 are located, light is not leaked to the outside, making it possible to light the keys 120 even more brightly.

A main advantage of the backlight keyboard 100 is that the specified places in the key cover 124 that need to be irradiated/illuminated become bright, while the rest stays dark. Thus, the key cover 124 is uniformly irradiated/illuminated, and the display characters and symbols are easy to see. In addition, it is possible to make the illuminated keyboard thinner and thus more portable. Moreover, each dome section 164 and each projection 127 are received in the through hole 142 of the light guide plate 140. Therefore, the dome section 164 and the projection 127 do not need to include an extra space to be provided by the keyboard 100, thereby further contributing to a reduced thickness needed for the keyboard 100.

Understandably, the opaque film 144 may, alternatively or additionally, be formed on the bottom surface 145 and/or the sidewalls 146 of the light guide plate 140 except for at the portions of the sidewall 146 adjacent to the light sources 146. In an alternative embodiment, the opaque film 144 may be formed on the upper surface 123 of the keypad 122, so as to block light which would otherwise be emitted from the areas around the key cover 124 of the key 120.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A backlight keyboard comprising:

a plurality of keys, each key comprising a key cover and a keypad connected together;

a light guide plate arranged below the keys, the light guide plate defining a plurality of through holes, each through hole corresponding to one key, an opaque film covering a top surface of the light guide plate, the keypad contacting the opaque film; and an elastic element positioned under the light guide plate and contacting the light guide plate, the elastic element being configured for exerting a force on at least one key so as to enable the key to return to its previous position when pressed and released, wherein each key further comprises a projection, each projection extends into a corresponding through hole of the light guide plate, the elastic member includes a plurality of dome sections, the dome sections are received in the through holes, and respectively correspond to the projections.

2. The backlight keyboard as claimed in claim 1, further comprising a plurality of key caps, each key cap being made of a plastic material, each key cap being respectively placed over a corresponding key cover and affixed thereto.

3. The backlight keyboard as claimed in claim 1, wherein the elastic member includes a plurality of dome sections, a front surface of each dome section expands outwardly toward a respective key cover, and each dome section has a contact formed on a rear surface thereof.

4. The backlight keyboard as claimed in claim 1, wherein the opaque film is made of non-light transmitting material.

5. The backlight keyboard as claimed in claim 1, wherein the opaque film is made of a reflective material.

6. The backlight keyboard as claimed in claim 1, wherein the light guide plate is comprised of at least one of methacrylate resin, polycarbonate (PC), polymethyl methacrylate (PMMA), and acrylonitrile butadiene styrene (ABS) resin.

7. The backlight keyboard as claimed in claim 1, wherein the opaque film is a baked-on varnish.

8. The backlight keyboard as claimed in claim 1, wherein the opaque film is an electroplated layer.

9. The backlight keyboard as claimed in claim 1, wherein the opaque film is a vapor-deposited layer.

10. The backlight keyboard as claimed in claim 1, wherein the opaque film is a printed film.

11. The backlight keyboard as claimed in claim 1, wherein the opaque film comprised of one of aluminium, a stainless steel, and a titanium compound.

12. The backlight keyboard as claimed in claim 1, wherein the opaque film is made of a light silver ink.

13. A backlight keyboard for a portable electronic device, comprising:

a plurality of keys, each pair of adjacent keys having a space therebetween;

a light guide plate arranged below the keys, the light guide plate forming a light-permeable area and a non-light-permeable area; and an elastic element positioned under the light guide plate and contacting the light guide plate;

wherein the non-light-permeable area of the light guide blocks light emitted from the spaces between the keys, and the light-permeable area allows the respective keys to be illuminated, each key further comprises a projection, each projection extends into a corresponding through hole of the light guide plate, the elastic member includes a plurality of dome sections, the dome sections are received in the through holes, and respectively correspond to the projections.

14. The backlight keyboard as claimed in claim 13, wherein each key comprises a keypad, a key cover, and a connecting portion, and the connecting portion connects the key cover to the keypad, the keypad contacts the non-light-permeable area of the light guide plate.

15. The backlight keyboard as claimed in claim 14, further comprising a plurality of key caps, and further wherein each key cap is made of a plastic material, and the key cap is placed over the key cover and affixed thereto.

16. The backlight keyboard as claimed in claim 14, wherein the opaque film is comprised of one of a non-light transmitting material and a reflective material.

* * * * *